United States Patent [19]

Behrendt

[11] 4,315,354

[45] Feb. 16, 1982

[54] CASKET CARRIER

[76] Inventor: Paul Behrendt, 9429 N. Avers, Evanston, Ill. 60203

[21] Appl. No.: 183,189

[22] Filed: Sep. 2, 1980

[51] Int. Cl.[3] ..... A61G 17/00

[52] U.S. Cl. ..... 27/27

[58] Field of Search ..... 27/27; 294/15

[56] References Cited

U.S. PATENT DOCUMENTS

| | | | |
|---|---|---|---|
| 737,580 | 9/1903 | Carpenter et al. | 27/27 |
| 937,086 | 10/1909 | Montross | 27/27 |
| 1,224,383 | 5/1917 | Jones | 27/27 |
| 1,292,268 | 1/1919 | Decamp | 27/27 |
| 2,198,997 | 4/1940 | Hickey | 27/27 |

*Primary Examiner*—John D. Yasko

*Attorney, Agent, or Firm*—Edward C. Threedy

[57] ABSTRACT

An independant carrier for caskets and the like, which carrier provides handles whereby the casket may be readily carried about with the carrier capable of having the handles folded into a collapsible relationship for storage and ease of handling when not in use.

8 Claims, 6 Drawing Figures

CASKET CARRIER

SUMMARY OF THE INVENTION

The present day practice is to construct caskets with permanent handles connected to its side and end walls. This construction requires that the casket have holes formed through its walls for receiving fasteners and the like for connecting the handle mountings to the casket. These holes must be permanently sealed by suitable sealing material which at best is non-permanent. The use of fixed handles is an added cost to the construction of the casket and therefore results in its higher retail value.

An object of this invention is to provide a casket carrier that will provide detatchable handles whereby a casket may be readily transported and with the carrier being retrieved and collapsed into a compact condition for easy transportation and storage.

A further object of this invention is to provide carrying handles for a casket without the necessity of forming holes or the like in the walls of the casket thereby permitting the use of a truly sealed water tight casket for burial purposes.

Another object of this invention is to provide a carrier that provides handles which may be of various ornamental designs.

Yet a further object of this invention is to provide a casket carrier which can be produced at a substantial saving in material and labor, and one which will not disrupt the configuration of design of the casket it is to carry.

DESCRIPTION OF THE INVENTION

Figure 1:
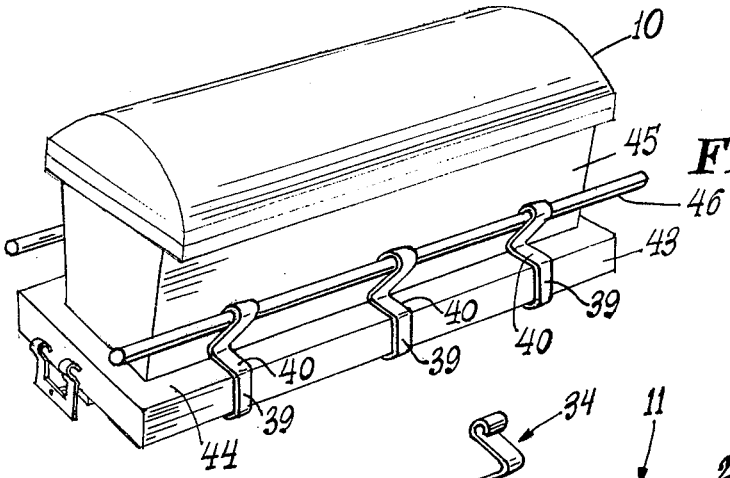
Figure 2:
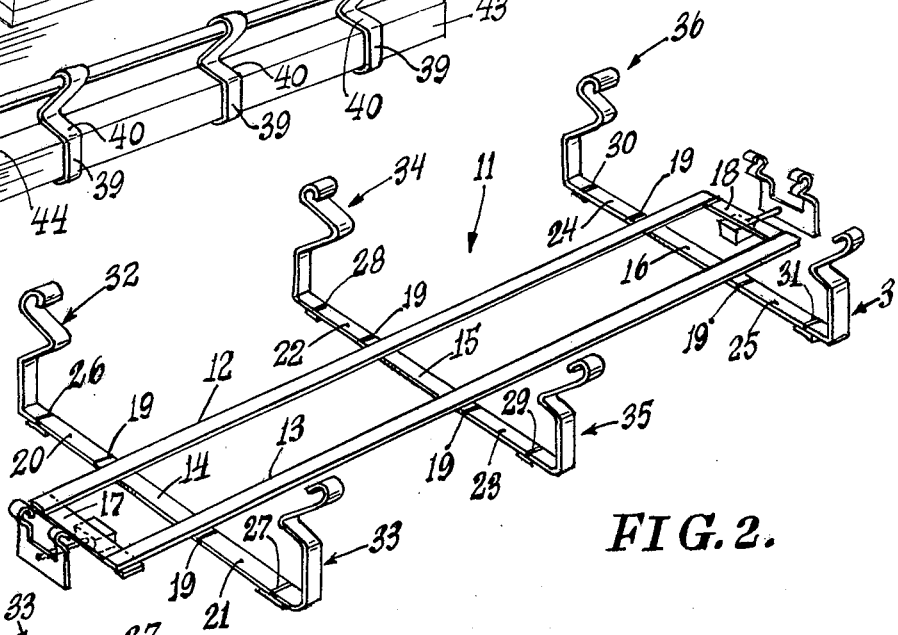
Figure 3:
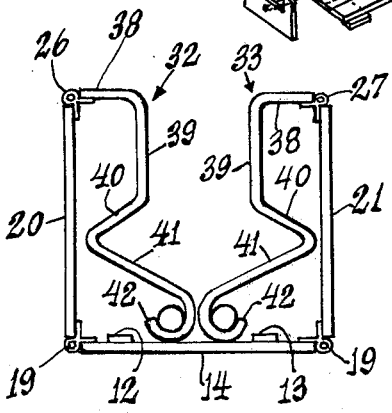
Figure 4:
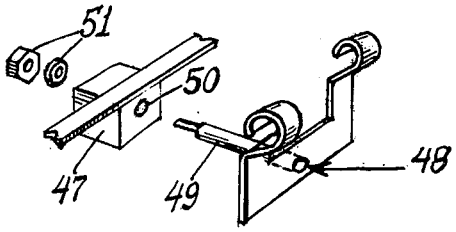
Figure 5:
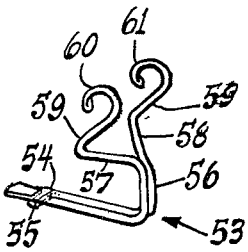
Figure 6:
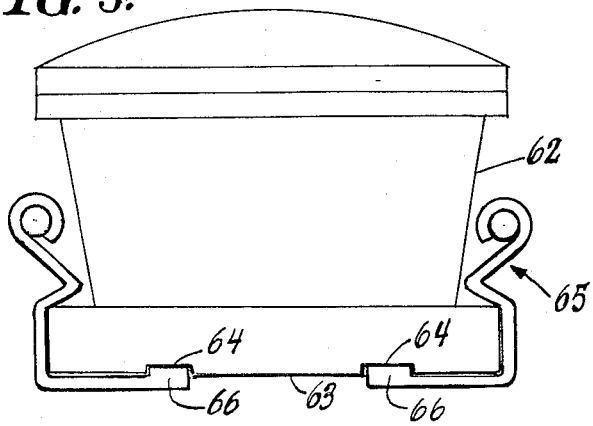

The invention will be best understood by reference to accompanying drawings showing the preferred form of construction by which the objects of this invention are achieved and in which:

FIG. 1 is a perspective view of a casket mounted on the casket carrier of this invention, FIG. 2 is a perspective view of the casket carrier of this invention, FIG. 3 is a perspective view of the carrier in its collapsed or stored condition, FIG. 4 is a perspective view of the end handle construction showing the parts in exploded relationship, FIG. 5 is a modified configuration of the handle supporting brackets of the casket carrier, and FIG. 6 is another modified form of the removable casket handles.

GENERAL DESCRIPTION

As illustrated, the invention is designed for the transporting of a casket 10. As such, the casket carrier comprises a carrier frame 11 consisting of a pair of longitudinally extending runners 12 and 13 connected together by a series of cross braces 14, 15, and 16. A pair of end braces 17 and 18 extend between the runners 12 and 13 at opposite ends thereof.

A series of hinges 19 are connected to the ends of the cross braces 14, 15 and 16. Attached to these hinges 19 are extensions 20, 21, 22, 23, 24 and 25. These extensions 20 through 25 have at their free ends a series of second hinges 26, 27, 28, 29, 30 and 31.

Connected to these second hinges 26 through 31 are a plurality of handle supporting brackets 32, 33, 34, 35, 36 and 37.

Each of these handle supporting brackets 32 through 37 consists of a straight member 38, with a straight member 38 attached to each of the series of second hinges as seen in FIG. 3. A leg 39 extends at right angles to the straight member 38 and it terminates into an angled back portion 40 that continues into a reverse curve 41 that terminates into a semi-circular handle grip 42.

As viewed in FIG. 1, the leg portion 39 of the handle supporting brackets will normally lie in facial abutment with a raised base wall 43 provided by the casket 10. The angled portion 40 will also engage a wall portion 44 of the casket. The reverse bend 41 then places the handle grips 42 in a spaced relation to the side wall 45 of the casket 10. In this position, the carrier is capable of transporting the casket.

An elongated handle rod 46 will extend through all of the handle grips 42 of all of the handle supporting brackets as shown.

Each of the end braces 17 and 18, as shown in FIG. 4, provides on the underside thereof, intermediate of its ends, a bearing 47. An end handle supporting bracket 48, having the same configuration as that of the handle supporting brackets 26 through 31, provides a connecting lug 49 which is adapted to be freely journaled in the opening 50 formed throughout the bearing 47. By a suitable retaining washer and nut 51, the end handle support bracket 48 is rotably connected to the end brace 18. When the casket is to be moved off either end of the carrier frame 11, the end handle support bracket 48 need only be rotated through 180° so as to be out of the path of such movement.

As illustrated in FIG. 3, when the carrier is placed in its collapsed condition, the handles 46 will be disposed inwardly of the straight portions of the carrier, extending parallel to said runners, and thus be protected against damage.

FIG. 5 shows a modified handle supporting bracket 53. This modified bracket 53, rather than being formed from flat metal stock, is constructed from metallic rod members. As such, the extension member 54 of the cross braces extending from the second hinge 55 consists of a double rod welded together. This double rod extends through the right angled leg 56 and, at the point of angling back, the rod members 57 and 58 are separate, and, as shown, continues in separate paths through that portion 59 of the bracket as well as through the reverse curve terminating into spaced handle grips 60 and 61.

FIG. 6 illustrates a modified form of removable casket handles and, as such, requires a modified casket 62 which has formed in the bottom 63, adjacent to each side thereof, internal grooves 64. The handle supporting brackets 65 of the modified version are generally of the same construction as that heretofor defined, except that in the place of the second hinges 26 through 31, the modified bracket 65 terminates. Each of the brackets 65 are connected together by an elongated stringer 66 which frictionally fits within the groove 64 formed in the bottom of the casket 63. By this arrangement, the handle as well as the handle supporting brackets 60 of the modified form may be readily removed from the casket.

While I have illustrated and described the preferred form of construction for carrying my invention into effect, this is capable of variation and modification without departing from the spirit of the invention. I therefore do not wish to be limited to the precise details of construction as set forth, but desire to avail myself of such variations and modifications as come within the scope of appended claims.

Having thus described my invention, what I claim as new and desire to protect by letters patent is:

1. A casket carrier comprising:

(a) a collapsible frame, (b) said frame consisting of spaced apart elongated runners, a plurality of cross members extending beyond and to either side of said runners, (c) handle supporting brackets connected to the ends of said cross members adapted to have facial contact with a portion of the sides of a casket when the latter is placed upon the carrier so as to hold the casket thereon, (d) means for pivotally connecting said brackets to the ends of said cross members whereby said brackets may be folded into a collapsed position relative to said runners, (e) means provided by said brackets for removably holding an elongated handle is a parallel elevated relation to said runners, and in a spaced relation to the sides of a casket when said cross members are in an extended casket recieving position, and (f) an elongated handle held by said means provided by said brackets by which a casket placed on the carrier may be carried.

2. A casket carrier as defined by claim 1 wherein said means for pivotally connecting said brackets to said cross members comprises hinges whereby said brackets may be pivoted back upon said cross members when said carrier is in a collapsed, stored condition.

3. A casket carrier as defined by claim 1 wherein said means provided by said brackets for holding said elongated handle comprise open grip-like elements as the free ends of said brackets spaced outwardly of the side walls of a casket placed upon said carrier.

4. A casket carrier as defined by claim 3 wherein said means for pivotally connecting said brackets to said cross members comprises hinges whereby said brackets may be pivoted back upon said cross members when said carrier is in a collapsed, stored condition.

5. A casket carrier as defined by claim 1 including end braces extending between said runners adjacent to the ends thereof, handle-supporting brackets connected to said end, and means for connecting said handle-supporting brackets to said end braces whereby said brackets can be pivoted about a vertical axis 180° from a position above said runners to a position below said runners so as to provide access to said runners for a casket to be placed thereon, and removed therefrom.

6. A casket carrier as defined by claim 5 wherein said means for pivotally connecting said brackets to said cross members comprises hinges whereby said brackets may be pivoted back upon said cross members when said carrier is in a collapsed, stored condition.

7. A casket carrier as defined by claim 5 wherein said means provided by said brackets for holding said elongated handle comprise open grip-like elements at the free ends of said brackets spaced outwardly of the side walls of a casket placed upon said carrier.

8. A casket carrier as defined by claim 4 including end braces extending between said runners adjacent to the ends thereof, handle supporting brackets connected to said end braces, and means for connecting said handle supporting brackets to said end braces whereby said brackets can be pivoted through a vertical axis 180° from a position above said runners to a position below said runners so as to provide access to said runners by a casket placed thereon and removed therefrom.

* * * * *